US006913535B2

(12) United States Patent
Kaminkow et al.

(10) Patent No.: US 6,913,535 B2
(45) Date of Patent: Jul. 5, 2005

(54) GAMING DEVICE HAVING MULTIPLE SELECTABLE CHANGING AWARDS

(75) Inventors: Joseph E. Kaminkow, Reno, NV (US); Paulina Glavich, Reno, NV (US)

(73) Assignee: IGT, Reno, NV (US)

( * ) Notice: Subject to any disclaimer, the term of this patent is extended or adjusted under 35 U.S.C. 154(b) by 42 days.

(21) Appl. No.: 10/825,774

(22) Filed: Apr. 16, 2004

(65) Prior Publication Data

US 2004/0198488 A1 Oct. 7, 2004

Related U.S. Application Data

(62) Division of application No. 09/960,785, filed on Sep. 21, 2001, now Pat. No. 6,722,983.

(51) Int. Cl.[7] ..... A63F 9/24
(52) U.S. Cl. ..... 463/26; 463/20
(58) Field of Search ..... 463/16, 20, 25, 463/26

(56) References Cited

U.S. PATENT DOCUMENTS

| | | | |
|---|---|---|---|
| 4,582,324 | A | 4/1986 | Koza et al. |
| 4,695,053 | A | 9/1987 | Vazquez, Jr. et al. |
| 5,092,598 | A | 3/1992 | Kamille |
| 5,205,555 | A | 4/1993 | Hamano |

(Continued)

FOREIGN PATENT DOCUMENTS

| | | | |
|---|---|---|---|
| EP | 0 874 337 | A1 | 10/1998 |
| EP | 0 984 407 | A2 | 3/2000 |
| GB | 2144644 | A | 3/1985 |

OTHER PUBLICATIONS

Jackpot Party Brochures and Articles written by WMS Gaming, Inc., published in 1998, 2000 and 2001.
Richard Petty Advertisement written by IGT, published in 2000.
Spell Binder Article written by Strictly Slots, published in 2000.
Good Times Advertisement written by IGT, published in 1999.
Psycho Cash Beast Advertisement written by IGT, published in 1999.
Slot Line Article describing Temperature Rising Game written by IGT, published in 1998.
Diamond Mine Advertisement written by IGT, published prior to 2001.

(Continued)

*Primary Examiner*—Derris H. Banks
*Assistant Examiner*—Corbett B. Coburn
(74) *Attorney, Agent, or Firm*—Bell Boyd & Lloyd LLC

(57) ABSTRACT

A gaming device having a game that may be implemented in a primary or bonus game. More specifically, the present invention provides a processor controlled gaming device that enables the player to build a number of awards by selecting choices from one or more sets of choices and further enables the player to select a final award choice that randomly provides one of the awards when the player finishes building the awards.

61 Claims, 11 Drawing Sheets

U.S. PATENT DOCUMENTS

| | | | |
|---|---|---|---|
| 5,536,016 | A | 7/1996 | Thompson |
| 5,707,286 | A | 1/1998 | Carlson |
| 5,788,573 | A | 8/1998 | Baerlocher et al. |
| 5,823,874 | A | 10/1998 | Adams |
| 5,855,514 | A | 1/1999 | Kamille |
| 5,947,820 | A | 9/1999 | Morro et al. |
| 6,015,346 | A | 1/2000 | Bennett |
| 6,059,289 | A | 5/2000 | Vancura |
| 6,089,976 | A | 7/2000 | Schneider et al. |
| 6,102,798 | A | 8/2000 | Bennett |
| 6,120,031 | A | 9/2000 | Adams |
| 6,126,542 | A | 10/2000 | Fier |
| 6,146,273 | A | 11/2000 | Olsen |
| 6,159,097 | A | 12/2000 | Gura |
| 6,159,098 | A | 12/2000 | Slomiany et al. |
| 6,168,523 | B1 | 1/2001 | Piechowiak et al. |
| 6,174,233 | B1 | 1/2001 | Sunaga et al. |
| 6,174,235 | B1 | 1/2001 | Walker et al. |
| 6,190,255 | B1 | 2/2001 | Thomas et al. |
| 6,203,429 | B1 | 3/2001 | Demar et al. |
| 6,220,959 | B1 | 4/2001 | Holmes, Jr. et al. |
| 6,231,442 | B1 | 5/2001 | Mayeroff |
| 6,231,445 | B1 | 5/2001 | Acres |
| 6,261,177 | B1 | 7/2001 | Bennett |
| 6,270,412 | B1 | 8/2001 | Crawford et al. |
| 6,309,300 | B1 | 10/2001 | Glavich |
| 6,315,664 | B1 | 11/2001 | Baerlocher et al. |
| 6,319,123 | B1 | 11/2001 | Paludi |
| 6,319,124 | B1 | 11/2001 | Baerlocher et al. |
| 6,328,649 | B1 | 12/2001 | Randall et al. |
| 6,336,860 | B1 | 1/2002 | Webb |
| 6,346,043 | B1 | 2/2002 | Colin et al. |
| 6,347,996 | B1 | 2/2002 | Gilmore et al. |

OTHER PUBLICATIONS

Neon Nights Brochures written by IGT, published in 2000.

Price is Right—Showcase Show Down Advertisement written by IGT, published in 2001.

Addam Family Article written by Strictly Slots, published in Jul. 2000.

Bingo Advertisement written by Casino Data Systems, published in 1998.

Five Card Instant Bingo Advertisement written by IGT, published in 2000.

GAMING DEVICE HAVING MULTIPLE SELECTABLE CHANGING AWARDS

PRIORITY CLAIM

This application is a divisional application of U.S. patent application, Ser. No. 09/960,785, filed on Sep. 21, 2001 now U.S. Pat No. 6,722,983, entitled "Gaming Device Having Multiple Selectable Changing Awards," which is incorporated herein in its entirety.

CROSS-REFERENCE TO RELATED APPLICATIONS

The present invention relates to the following co-pending commonly owned U.S. patent applications: "GAMING DEVICE HAVING A BONUS SCHEME INCLUDING A PLURALITY OF SELECTION GROUPS WITH WIN-GROUP OUTCOMES," Ser. No. 09/981,084, "GAMING DEVICE HAVING A BONUS SCHEME WITH MULTIPLE SELECTION GROUPS," Ser. No. 10/243,047, "GAMING DEVICE HAVING A BONUS SCHEME WITH MULTIPLE SELECTION GROUPS," Ser. No. 10/623,421, "GAMING DEVICE HAVING A WEIGHTED PROBABILITY FOR SELECTING A BONUS GAME," Ser. No. 10/414,638, "GAMING DEVICE HAVING A BONUS ROUND WITH MULTIPLE RANDOM AWARD GENERATION AND MULTIPLE RETURN/RISK SCENARIOS," Ser. No. 09/678,989, "GAMING DEVICE HAVING A MULTIPLE SELECTION GROUP BONUS ROUND," Ser. No. 09/605,107, "APPARATUS AND METHOD FOR MODIFYING GENERATED VALUES TO DETERMINE AN AWARD IN A GAMING DEVICE," Ser. No. 09/957,018, "GAMING DEVICE HAVING A MULTIPLE SELECTION GROUP BONUS ROUND," Ser. No. 10/327,538, "GAMING DEVICE HAVING DUAL EVALUATION SCHEME," Ser. No. 09/687,689, "GAMING DEVICE HAVING A BONUS SCHEME WITH MULTIPLE POTENTIAL AWARD SETS," Ser. No. 09/822, 697, and "GAMING DEVICE HAVING A BONUS SCHEME WITH MULTIPLE POTENTIAL AWARD SETS," Ser. No. 10/652,457.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having at least two awards that increment upon successive player selections, wherein the player makes a final selection that randomly determines which award the gaming device provides to the player.

BACKGROUND OF THE INVENTION

Gaming devices provide enjoyment and excitement to players, in part, because they may ultimately lead to monetary awards for the players. Gaming devices also provide enjoyment and excitement to the players because they are fun to play. Bonus games, in particular, provide gaming device manufacturers with the opportunity to add enjoyment and excitement to that which is already expected from a base game of the gaming device. Bonus games provide extra awards to the player and enable the player to play a game that is different than the base game.

Gaming devices are typically games of luck, not skill. Primary games are set up to pay back a certain percentage of the amount of money inputted into the machine. The payout percentage in most primary games is set high enough that any player who plays a few hands or spins of the reels wins. That is, in most primary games it is not too difficult to experience some level of success.

Bonus games are typically set up for the player to succeed. The player usually wins an award in a bonus game. In bonus game play, the goal is often to maximize the possible award. Winning, at least on some level, is therefore a standard component in gaming devices. Moreover, the payout percentage of any gaming device is ultimately set by the relevant gaming jurisdiction and gaming establishment, not the game designer.

A continuing need therefore exists to provide gaming devices that issue awards in an exciting and enjoyable manner. In this respect, it is desirable to enable the player to have an impact on, or a hand in, determining their award. It is further desirable to increase the level of player interaction. Each of these features is desirable in a primary or secondary game.

SUMMARY OF THE INVENTION

The present invention provides a gaming device having a game that may be implemented in a primary or bonus game. More specifically, the present invention provides a processor controlled gaming device that enables the player to build a number of awards by selecting choices from one or more sets of choices and further enables the player to select a final award choice that randomly provides one of the awards when the player finishes building the awards. To this end, in one embodiment of the present invention, the player selects from a first set of choices until the player selects a choice that terminates selection from that set. For purposes of describing the present invention, the choice that ends the player's selection from the set is called a terminator. In one embodiment, only one set is provided to the player. In this embodiment, the terminator terminates selection from the single set and completes the building of the awards. In other embodiments a plurality of sets are sequentially provided to the player. In these embodiments, the terminator terminates the selection from one set and in turn initiates selection from another set.

In each set of one embodiment of the present invention, when the player selects a choice, the game provides an outcome. The sets include any one, combination of or all of the following outcomes: (i) a number of gaming device credits; (ii) a modifier such as a multiplier; and (iii) a terminator.

In addition to specifying a number of game credits or a multiplier, the choices also direct which award increments by the number of credits or the multiplier. In one embodiment, a set may include one or more choices that provides a number of credits or a multiplier to both awards or all of the awards. In another embodiment, a choice by the player may yield a number of credits that is subtracted from one or both or all of the awards.

The present invention includes at least one and preferably a plurality of sets of choices. The present invention also includes at least two and alternatively any number of awards that the player builds or increments through the selection of the choices. When the player selects a terminator from a set of choices, the game in a preferred embodiment reveals the outcome of any unselected choice in the set.

When the player selects a terminator from each set provided by the present invention, the competing awards are complete and a determination is made as to which award the player receives. In a preferred embodiment, the gaming device provides a plurality of award selections the award selections are separate from the choices displayed in association with their respective sets. The game preferably associates each award with an award selection. The player's selection of a particular award selection thereby determines which award the player receives.

In an alternative embodiment, the gaming device may be adapted to automatically randomly provide one of the awards to the player. This may be done in conjunction with a fun and exciting audio, visual or audio-visual demonstration by the display device. In another alternative embodiment, when the player selects one of the award selections, the gaming device may be adapted to question whether the player wishes to keep or change the initial selection. In yet another alternative embodiment, when the player selects one of the award selections, the gaming device may be adapted to provide one of the award plus an additional number of credits or a modifier such as a multiplier.

It is therefore an advantage of the present invention to provide a gaming device that builds a plurality of potential awards for the player and reveals these awards to the player.

It is another advantage of the present invention to provide a gaming device that builds a plurality of potential awards for the player and enables the player to select one of the awards.

It is a further advantage of the present invention to provide a gaming device that enables the player to build a plurality of potential awards by selecting choices from a plurality of sets of choices.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
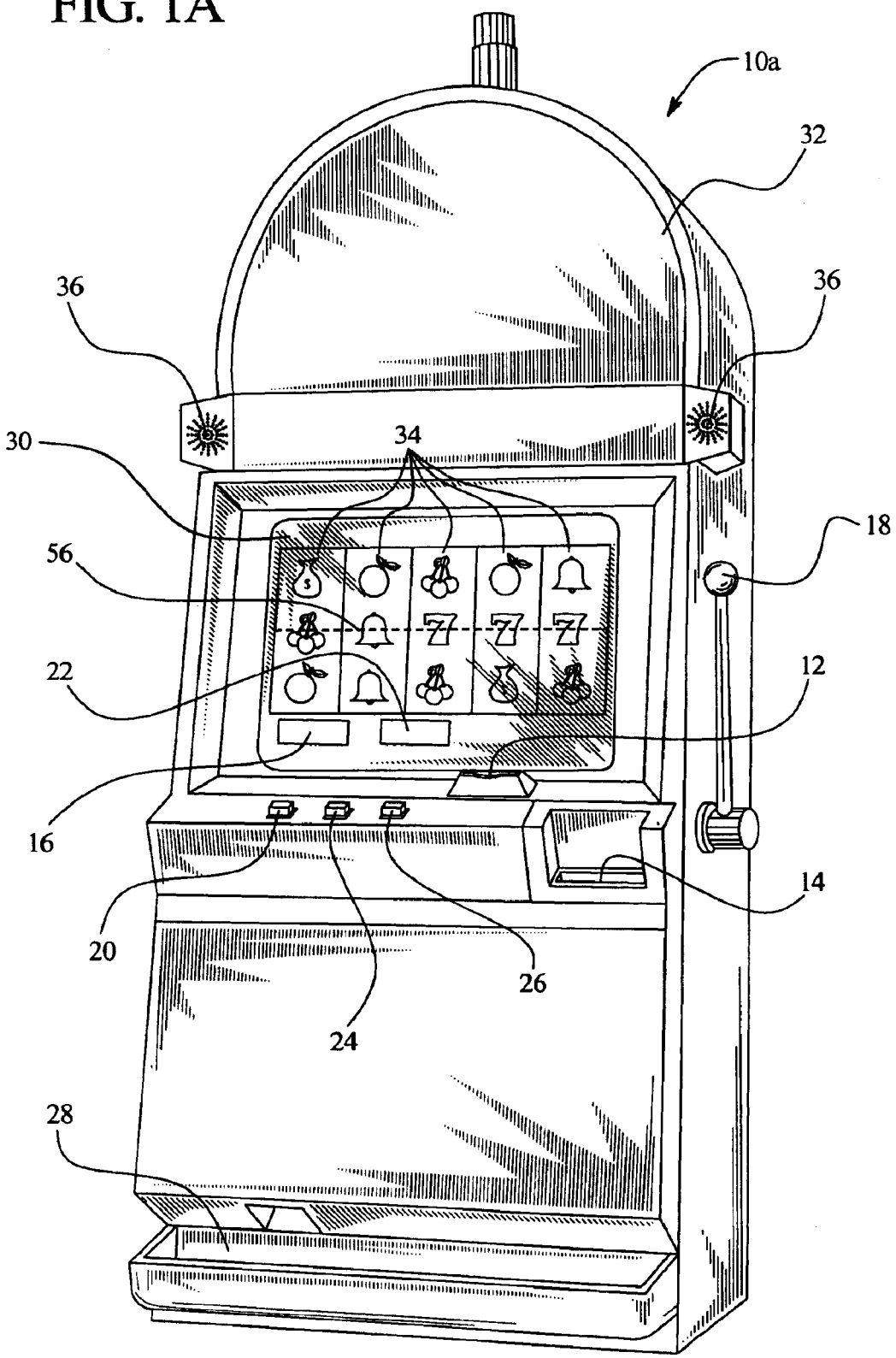
FIGS. 1A and 1B are perspective views of alternative embodiments of the gaming device of the present invention.
Figure 1B:
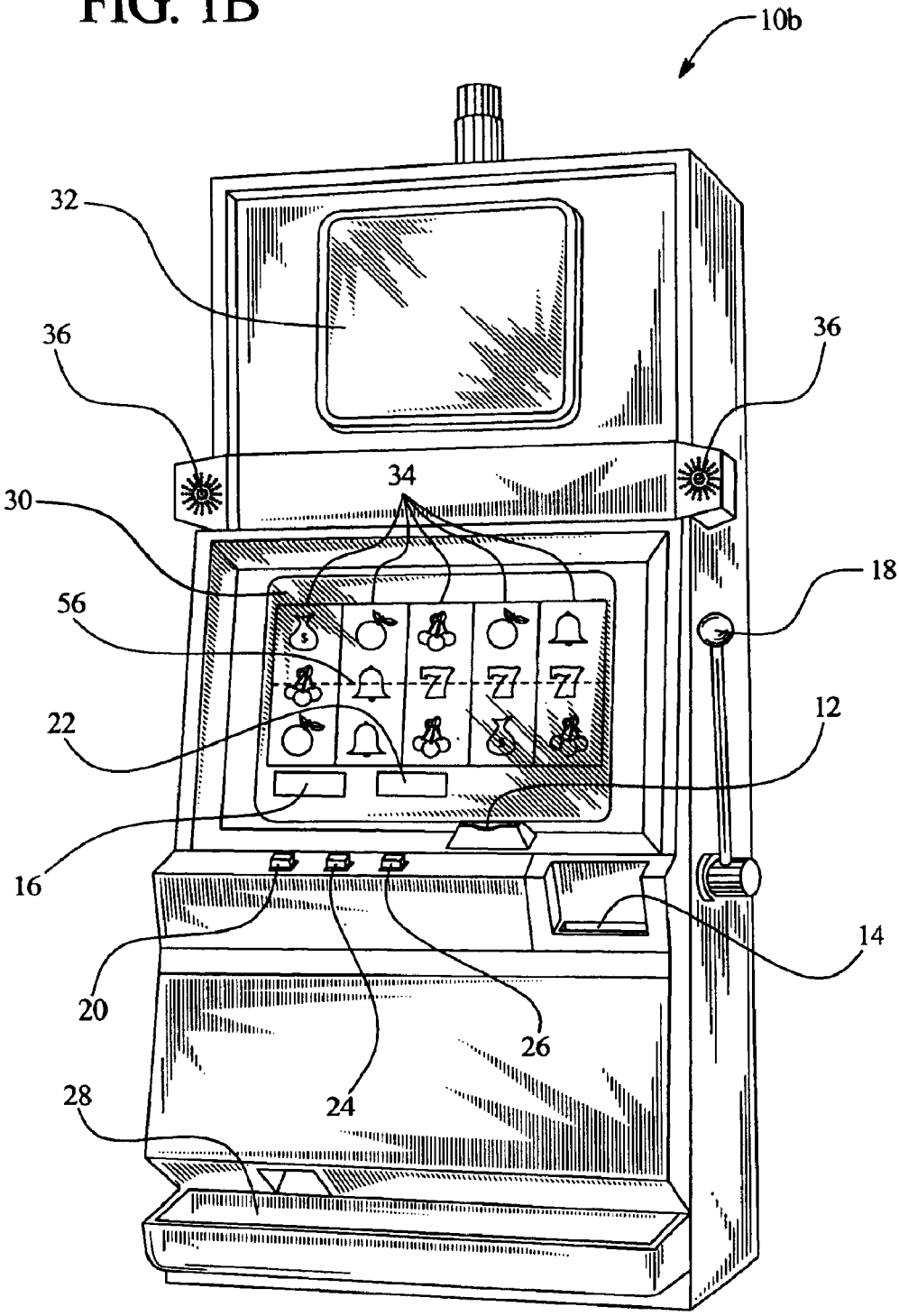

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base, bonus and progressive games include mechanical, electrical, electronic or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
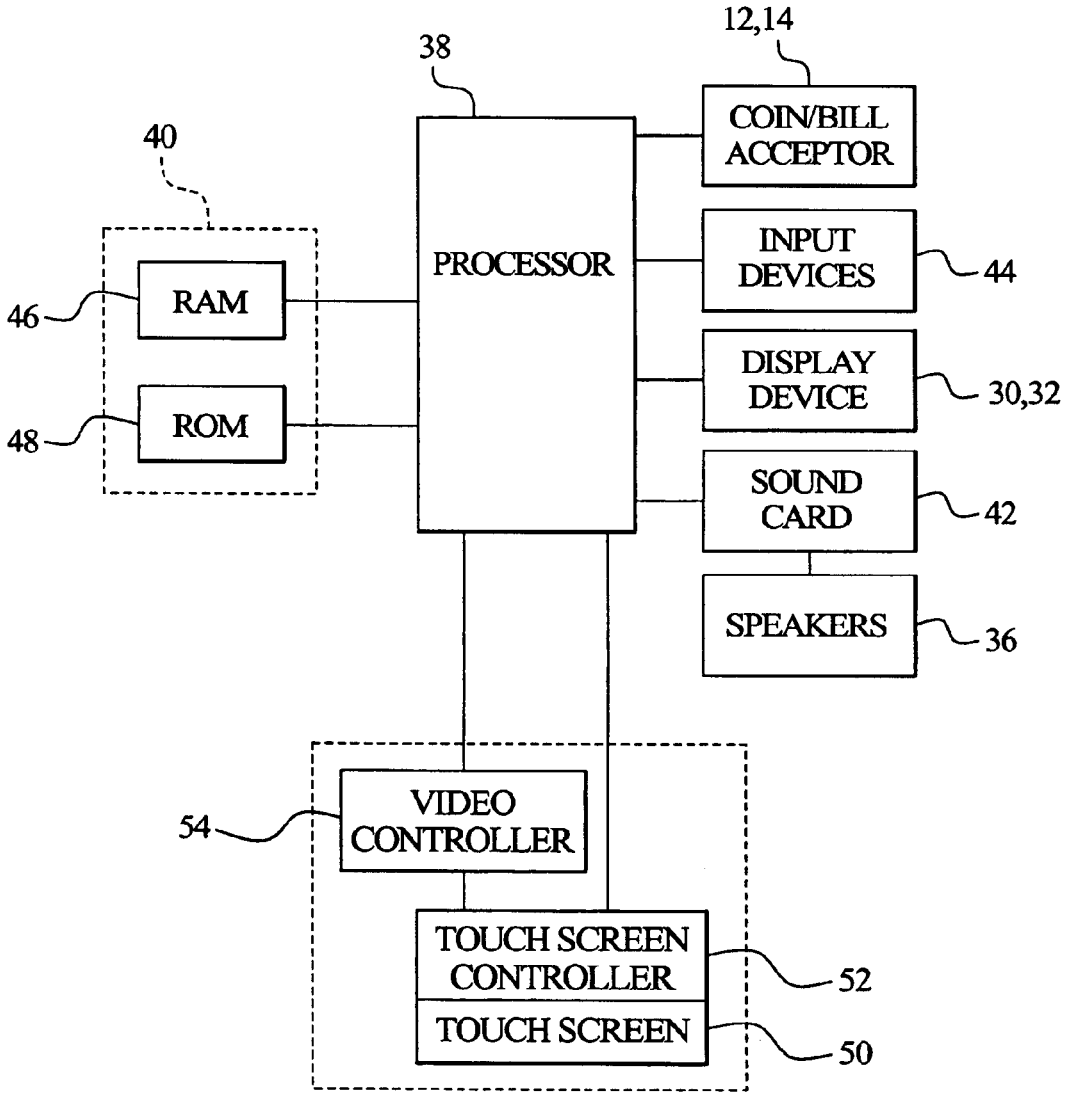
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Figure 3:
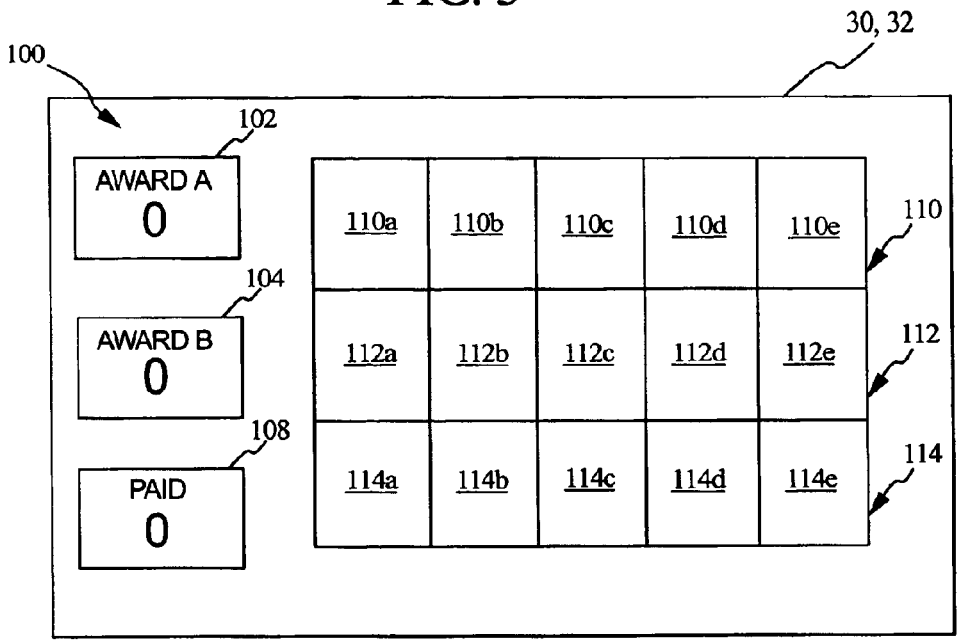
FIG. 3 is a front elevation view of a display device having one embodiment of an initial screen of the present invention.

Referring now to FIG. 3, a screen 100 of one of the display devices 30 or 32 displays one embodiment of an initial screen of the present invention. The screen 100 includes a plurality of competing awards including Award A and Award B, which are respectively displayed in award display 102 and award display 104. Each award has a beginning value and an accumulated value. The beginning values may be set at zero or any other value desired by the implemetor. In the initial screen 100, beginning values of Awards A and B are set to zero. A paid display 108 displays a number of credits that the gaming device 10 downloads to the player. When the player obtains either Award A or B, gaming device 10 moves the award from its respective award display to the paid display 108, which indicates that the player has actually received the award.

The initial screen 100 includes a plurality of sets 110, 112 and 114. Each set includes a plurality of choices. The set 110 includes choices 110*a* through 110*e*. The set 112 includes choices 112*a* through 112*e*. The set 114 includes choices 114*a* through 114*e*. A value or a function is associated with each choice as described in more detail below.

The display device 30 or 32 in a preferred embodiment includes a touch screen 50 and a touch screen controller 52, which communicates with the processor 38 of gaming device 10, as disclosed in connection with FIG. 2. The choices 110*a* through 110*e*, 112*a* through 112*e* and 114*a* through 114*e* in an embodiment are areas of the touch screen 50 that send discrete inputs to the processor 38. The processor 38 communicates with the memory device 40 that stores a game program, which has been configured to recognize the discrete inputs as the player's selection of various choices. That is, if the player wants whatever value is associated with a particular choice, the player presses the associated area of the display device 30 or 32. The touch screen therefore functions as a selector for enabling the player to select the choices.

In an alternative embodiment, the choices 110*a* through 110*e*, 112*a* through 112*e* and 114*a* through 114*e* are electromechanical inputs, located on a panel of the gaming device 10, as hard-wired input devices 44 (FIG. 2). The electromechanical inputs send a discrete input to the processor 38, as described above.

In the illustrated screen 100, each set includes the same number of choices, however, the sets may be adapted to include different numbers of choices. Each set preferably includes at least two choices. Although the sets are positioned in a grid pattern in the initial screen 100, the sets may appear in any configuration, so long as the player understands which choices belong to which sets.

Figure 4:
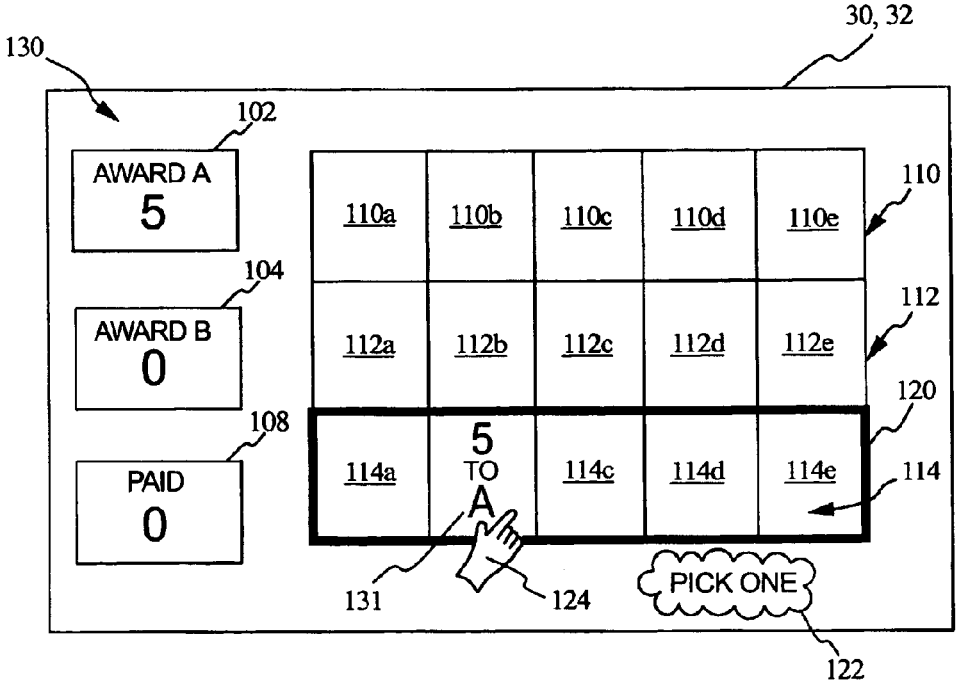
FIG. 4 is an elevation view of a display device illustrating the player's selection of a number of credits for a first award.

Referring now to FIG. 4, a screen 130 of one of the display devices 30 or 32 illustrates the sets 110 through 114, the award displays 102 and 104 and the paid display 108. An indicator 120 shown here as a dark bar around the set 114 indicates that the set 114 is the one from which the player should select a choice. The indicator 120 may be any suitable audio, visual or audio-visual display that designates one of the sets for selection.

Additionally, an audio, visual or audio-visual message 122, such as, "Pick One," informs the player to select one of the choices from the indicated set, here the set 114. The player 124 selects the choice 114*b* from the set 114. The selection of the choice 114*b* reveals an award component 131 of five credits that are to be awarded to Award A. The award display 102 increments the Award A appropriately.

Figure 5:
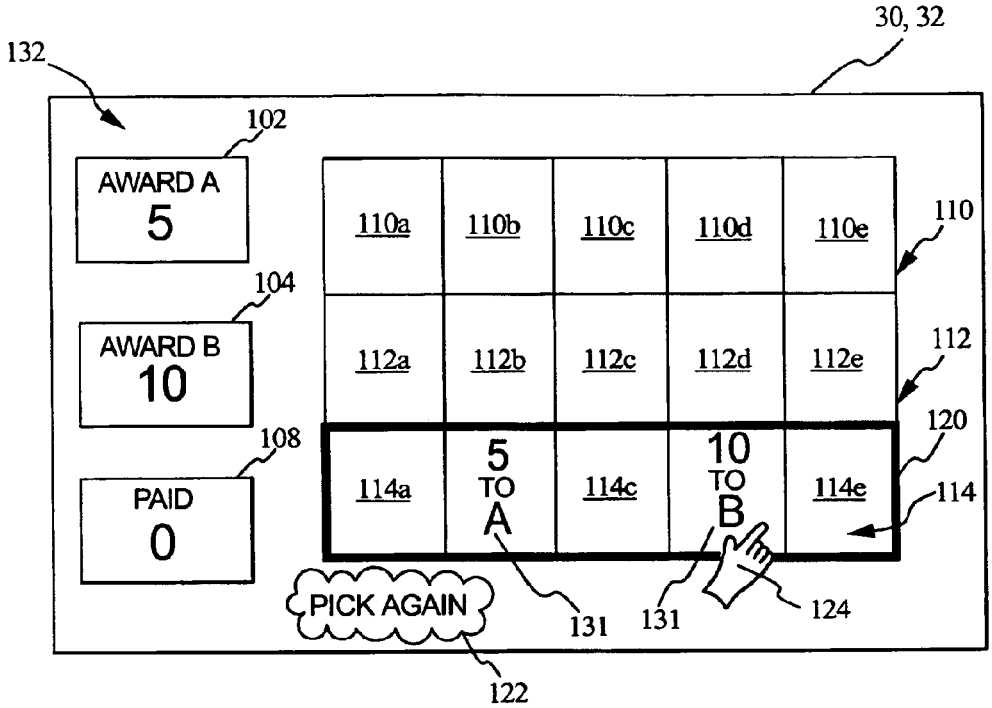
FIG. 5 is an elevation view of a display device illustrating the player's selection of a number of credits for a second award.

Referring now to FIG. 5, the screen 132 displays one of the display devices 30 or 32. The indicator 120 informs the player to again select from the set 114 and the message 122 informs the player to pick again. The player 124 selects the choice 114*d*, which yields an award component 131 of ten credits to Award B. The award display 104 updates to show the ten credits. The award display 102 still displays the five credits obtained in the screen 130. The paid display indicates that no award has actually been downloaded to the player at this point in game play. The screen 132 illustrates that the gaming device 10 builds or increments at least two competing awards.

Figure 6:
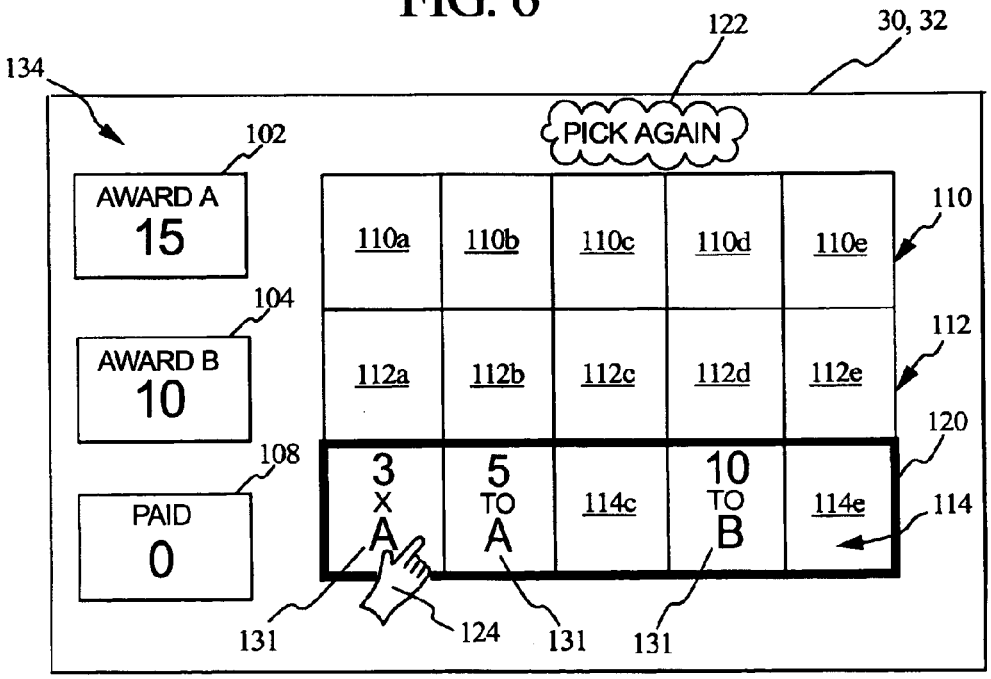
FIG. 6 is an elevation view of a display device illustrating the player's selection of a multiplier for the first award.

Referring now to FIG. 6, a screen 134 of one of the display devices 30 or 32 illustrates that the indicator 120 still designates the set 114 for selection. The message 122 informs the player to pick again. The player 124 selects the choice 114*a*, and gaming device 10 reveals an award component 131 of three times Award A behind choice 114*a*. The gaming device 10 multiplies Award A by three and displays the incremented Award A of fifteen in the display 102. It should be appreciated from the screen 134 that the award components of the present invention can be game credits or game credit multipliers.

Figure 7:
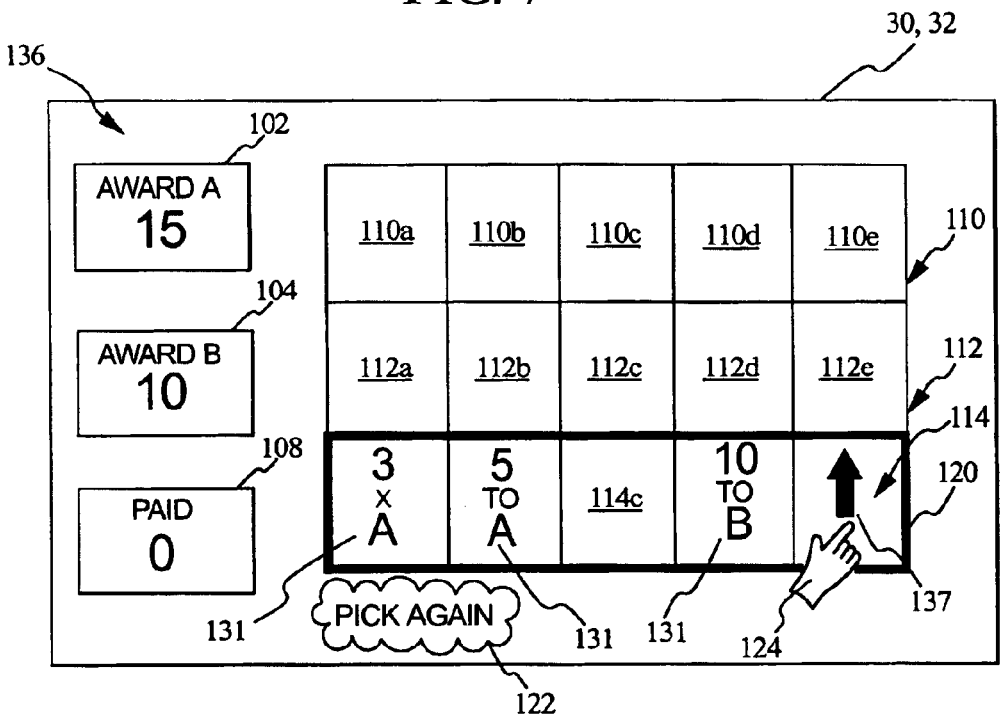
FIG. 7 is an elevation view of a display device illustrating the player's selection of a terminator.

Referring now to FIG. 7, a screen 136 of one of the display devices 30 or 32 illustrates that the indicator 120 still designates the set 114, the message 122 informs the player to pick again and the player 124 selects the choice 114*e*. The selection of the choice 114*e* reveals a selection terminator 137. In one preferred embodiment, each of the sets including the set 114 includes one or more selection terminators 137. When the player selects a terminator, the player is no longer enabled to pick from the set that has provided the terminator 137. Where multiple sets exist, such as the embodiment displayed on the screen 136, the terminator 137 also initiates selection from another set. In one embodiment, selection of the terminator 137 in the screen 136 does not increment either Award A or Award B and the displays 102 and 104 remain unchanged. In another embodiment, the terminator 137 may increment Award A, Award B or both Award A and B.

Figure 8:
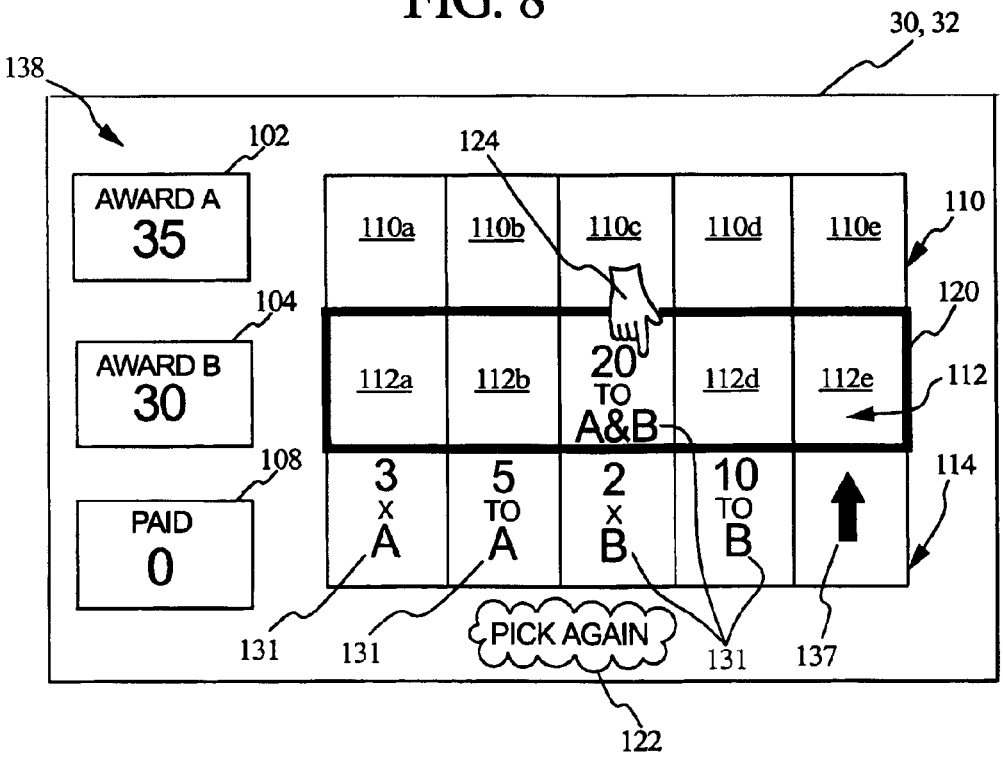
FIG. 8 is an elevation view of a display device illustrating the player's selection of a number of credits for the first and second awards.

Referring now to FIG. 8, a screen 138 of one of the display devices 30 or 32 illustrates that when the player selects a terminator 137 from a set, e.g., the set 114, gaming device 10 reveals any previously unrevealed choice. In the screen 138, the game reveals the unselected choice 114*c*, which shows the award component 131 of 2 times B. In an alternative embodiment, gaming device 10 does not reveal unselected choices of a set upon the player's selection of a terminator 137. Revealing award components 137 that the player could have selected, however, increases enjoyment and excitement.

In the screen 138 of FIG. 8, the indicator 120 now designates the set 112 as a set from which the player is to choose. The message 122 informs the player to pick again, and the player 124 selects the choice 112*c*. The selection of the choice 112*c* reveals the award component 131 of twenty credits to both Awards A and B. As illustrated in the displays 102 and 104, both Award A and Award B increment by twenty credits. It should be appreciated from the screen 138, that any award component 131, be it a number of credits or a modifier such as multiplier, may increment a single award, a plurality of awards or all of the awards.

Figure 9:
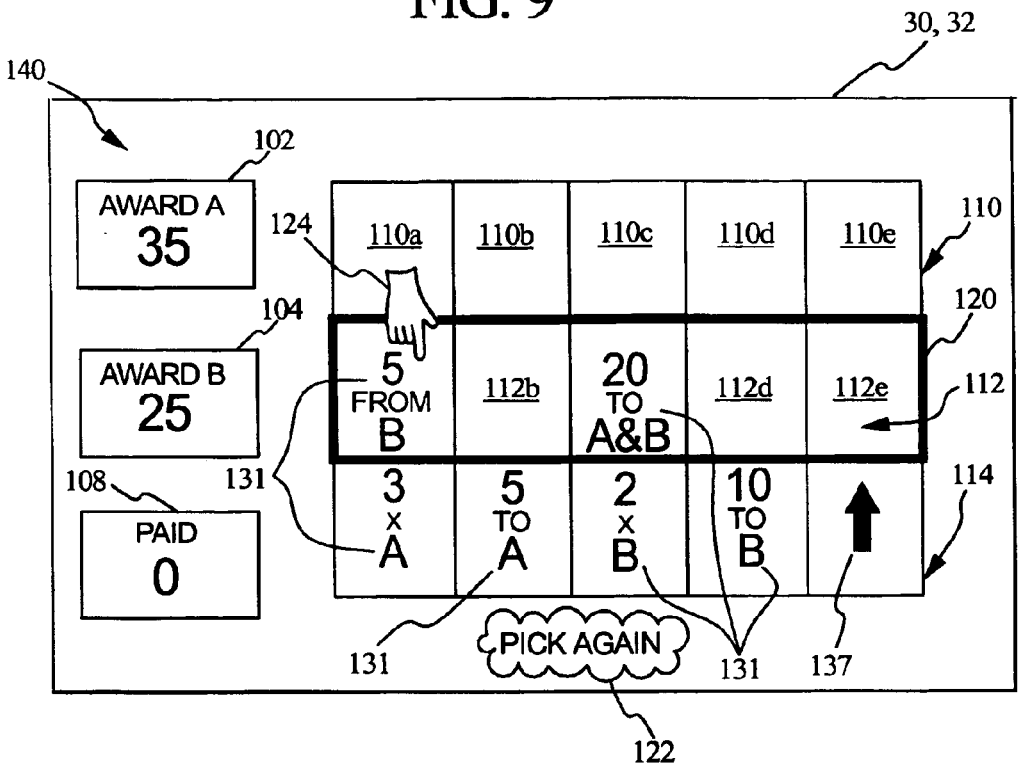
FIG. 9 is an elevation view of a display device illustrating the player's selection of a number of credits that are subtracted from the second award.

Referring now to FIG. 9, a screen 140 of one of the display devices 30 or 32 illustrates that the indicator 120 still designates the set 112 as the set from which the player is to choose. The player selects the choice 112*a*, and gaming device 10 reveals the award component 131 of five credits from Award B. That is, gaming device 10 subtracts five credits from the Award B so that the award display 104 for Award B only displays twenty-five credits. The screen 140 illustrates that any award component 131 may increase or decrease the awards A and B.

Figure 10:
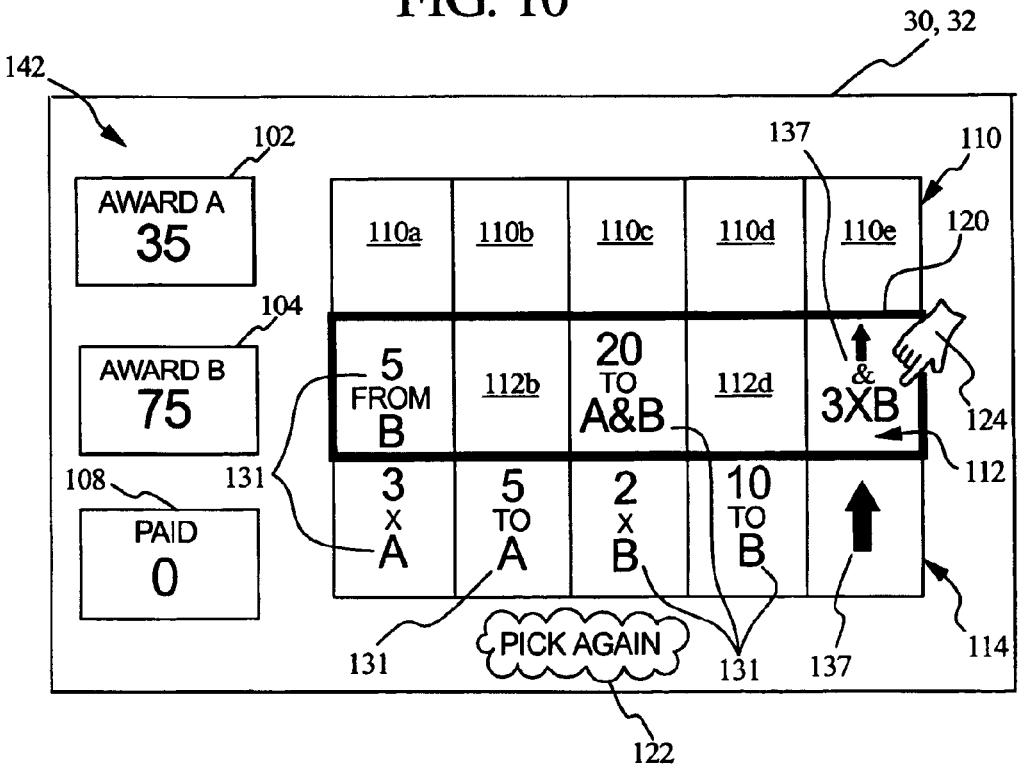
FIG. 10 is an elevation view of a display device illustrating the player's selection of a terminator having an accompanying multiplier.

Referring now to FIG. 10, a screen 142 of one of the display devices 30 and 32 illustrates that the indicator 120 still designates the set 112 and the message 122 informs the player to pick again. The player 124 selects the choice 112*e*, and gaming device 10 reveals a terminator 137 for the set 112. The screen 142 illustrates that the terminator 137 also includes a multiplier, here a multiplier of three that multiplies Award B. The award display 104 accordingly increments Award B to seventy-five credits. As with the award components 131, multipliers provided with a terminator 137 may be adapted to multiply one of, a combination of or all of the awards.

Figure 11:
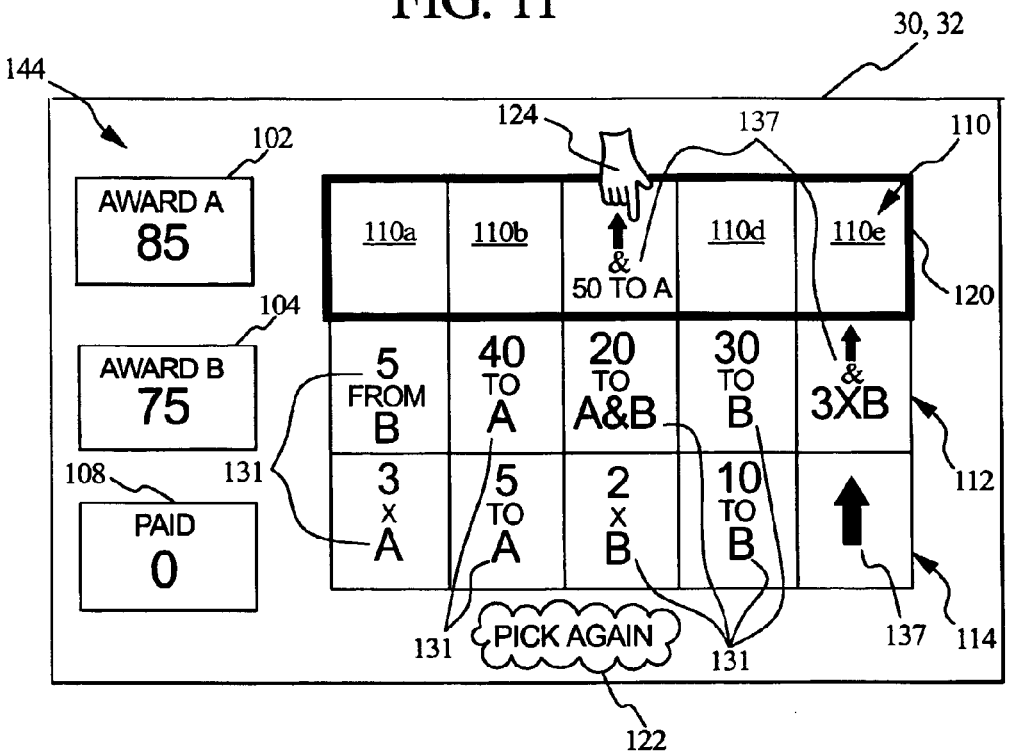
FIG. 11 is an elevation view of a display device illustrating the player's selection of a terminator having an accompanying number of credits.

Referring to FIG. 11, a screen 144 of one of the display devices 30 or 32 illustrates that the indicator 120 now designates the set 110. Upon the player's selection of the terminator 137 from the set 112 in the previous screen, the gaming device 10 reveals all unselected choices, namely, choices 112*b* and 112*d*. The message 122 informs the player to pick again, and the player 124 selects the choice 110*c*. The selection of the choice 110*c* reveals that the player has selected an indicator 137 upon the first selection of the set 110. In the screen 144, the terminator 137 is accompanied by an additional number of credits for Award A. The screen 144 illustrates that the terminator 137 may be adapted to add an additional number of credits to one of, a combination of or all of the awards. The award display 102 increments Award A by fifty credits to eighty-five credits.

Figure 12:
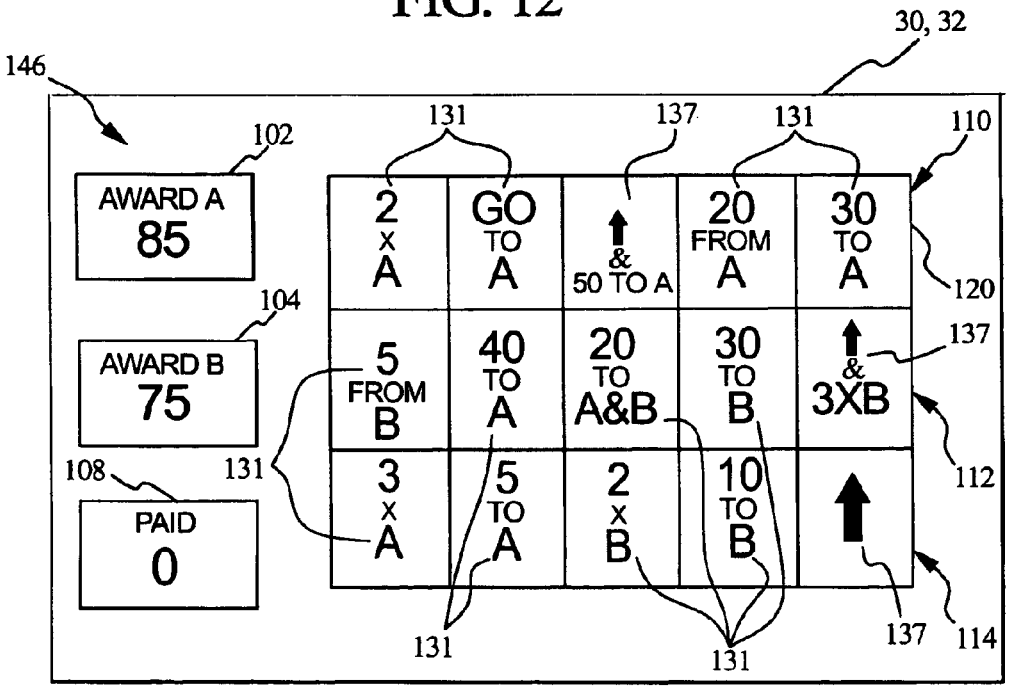
FIG. 12 is an elevation view of a display device illustrating a reveal feature of the present invention.

Referring now to FIG. 12, a screen 146 of one of the display devices 30 or 32 illustrates that each of the award components 131 and terminators 137, in a preferred embodiment, is revealed upon the player's selection of a terminator in the final set. That is, when the player 124 selects the terminator 137 in the set 110, which is the last available set, the game reveals all unselected choices, namely, choices 110*a*, 110*b*, 110*c* and 110*d*. In the illustrated screens, each set only contains one terminator 137, however, each set may contain zero, one or more terminators 137.

It should be appreciated that while the sets 112 and 114 contain award components 131 and terminators 137 that increment both Award A and Award B, the set 110 only increments Award A. The game designer may provide one or more sets that only increment one of or a percentage of the different awards. The credits and multipliers may be distributed equally among the competing awards, so as to make them both increment roughly equally, on average. The credits and multipliers may alternatively be distributed unequally so as to create one or more desirable awards for the player.

It should be appreciated from the foregoing screens that the paid display 108 still shows zero credits. The game has not yet downloaded any award to the player. At this point in the game sequence, Awards A and B are now complete. That is, the player has no more opportunities to build or increment either award. At this point in the game program, it is time for the player or the gaming device 10 to select one of the awards to issue to the player.

Figure 13:
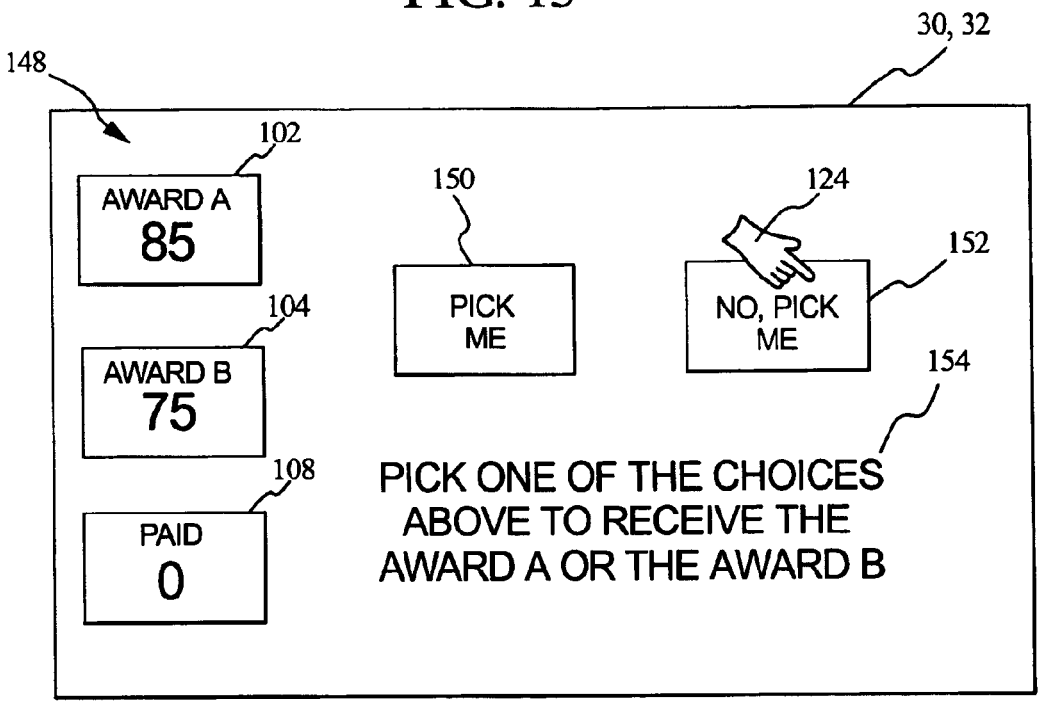
FIG. 13 is an elevation view of a display device illustrating the player's selection of one of the first and second award choices.

Referring now to FIG. 13, a screen 148 of one of the display devices 30 or 32 illustrates that gaming device 10 displays two award selections to the player, namely, the award selections 150 and 152. In the illustrated embodiment, the screen 148 no longer displays the sets 110 through 114, however, in an alternative embodiment the award selections 150 and 152 may be displayed in addition to the sets. A new audio, visual or audio-visual message 154 informs the player to pick one of the selections to receive either Award A or Award B. The selections 150 and 152 can also have indicia prompting the player. As illustrated, the player 124 selects the award selection 152.

Figure 14:
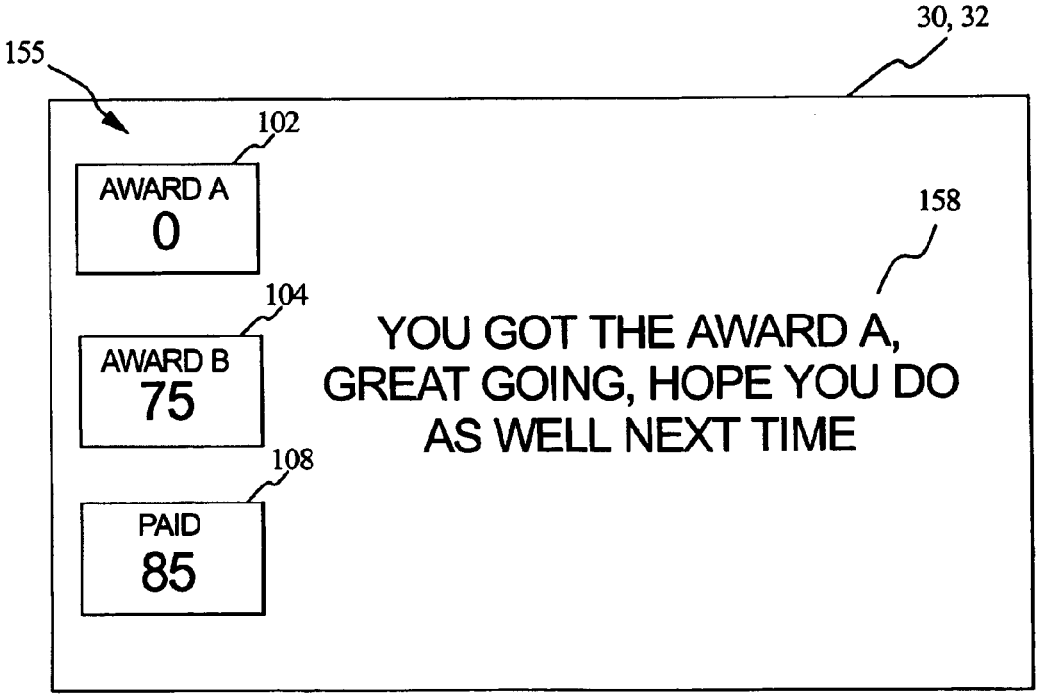
FIG. 14 is an elevation view of a display device illustrating the player's receipt of one of the first and second awards.

Referring now to FIG. 14, a screen 155 of one of the display devices 30 or 32 illustrates the outcome of the player's selection of the award selection 152. The screen 155 provides an audio, visual or audiovisual message 158 that informs the player that gaming device 10 has issued Award A to the player. The paid display 108 accordingly shows the award of 85 that has previously been displayed in the display 102. In an embodiment, a credit roll-up may be employed so that the award display 102 counts backward from eighty-five to zero as the paid display 108 increments from zero to eighty-five.

The award provided or downloaded to the player in the paid display 108 is in one embodiment a number of game credits. In another embodiment, the award may be a multiplier that multiplies some other number or amount of game credits such as the player's total bet, a bet per payline, the number of paylines wagered, a win along a payline, a total win along all wagered paylines, a win in a scatter pay, etc. The award may further alternatively signify a number of picks from a prize pool.

Figure 15:
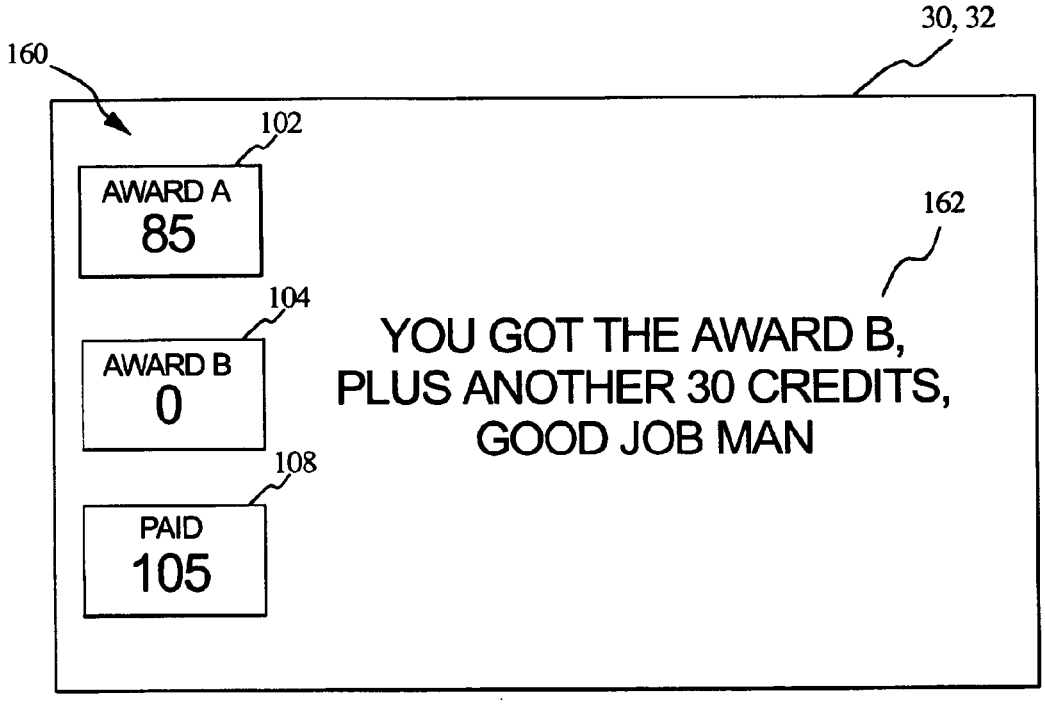
FIG. 15 is an elevation view of a display device illustrating the provision of one of the first and second awards plus an additional number of credits.

Referring now to FIG. 15, a screen 160 of one of the display devices 30 or 32 illustrates an alternative embodiment wherein gaming device 10 issues one of the awards and also adds a number of credits to or multiplies the selected award. In this case gaming device 10 provides message 162 via any mode of communication discussed herein and adds thirty credits to the Award B. The award display 104 for Award B no longer displays the seventy-five credits. The paid display 108 indicates that one hundred five credits, i.e., seventy-five credits plus thirty credits, has been issued to the player.

The screen 148 of FIG. 13 illustrates one embodiment wherein the player has an input into which award the player receives. Gaming device 10 also has an input in that it randomly associates via any suitable random generation device each award with one on the award selections 150 and 152. In an alternative embodiment, the random generation device may simply generate one of the awards displayed in the displays 102 and 104 for the player. Thus, in the screen 156 of FIG. 14, the gaming device may alternatively go through a sequence wherein it appears it is determining which award to provide to the player before presenting the message 158 indicating which award the player is to receive.

In another alternative, gaming device 10 may provide one or more audio, visual or audio-visual tease sequences (not illustrated). A tease sequence prompts the player, after the player selects one of the award selections 150 or 152, whether the player wishes to keep or change the player's selection. The tease sequence adds to the excitement and enjoyment of gaming device 10.

Figure 16:
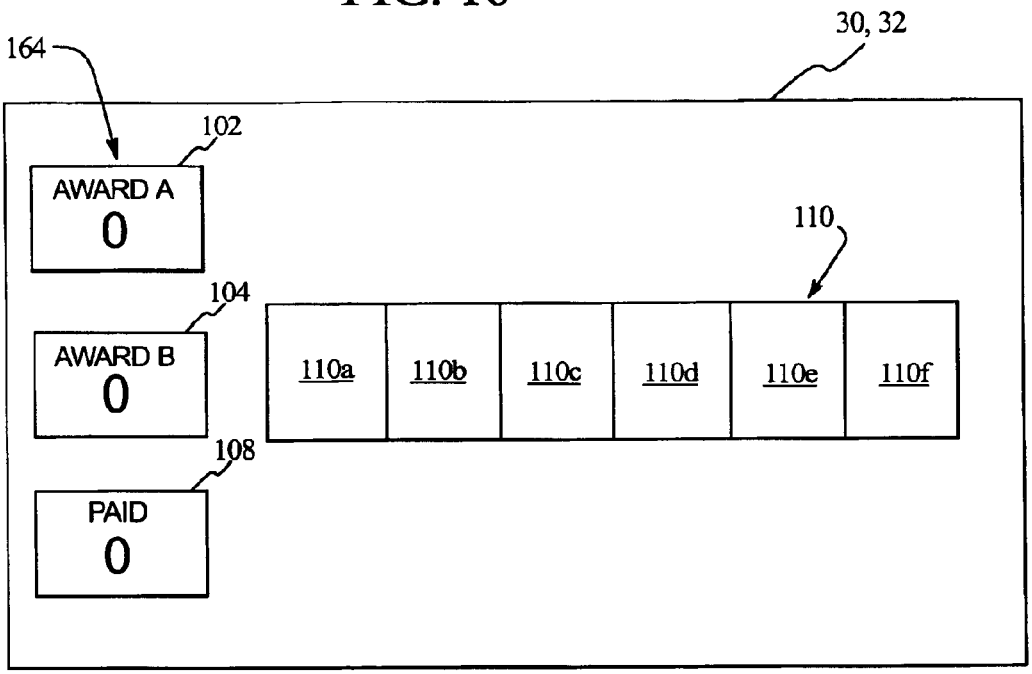
FIG. 16 is an elevation view of a display device illustrating an alternative initial screen of the present invention.
Figure 17:
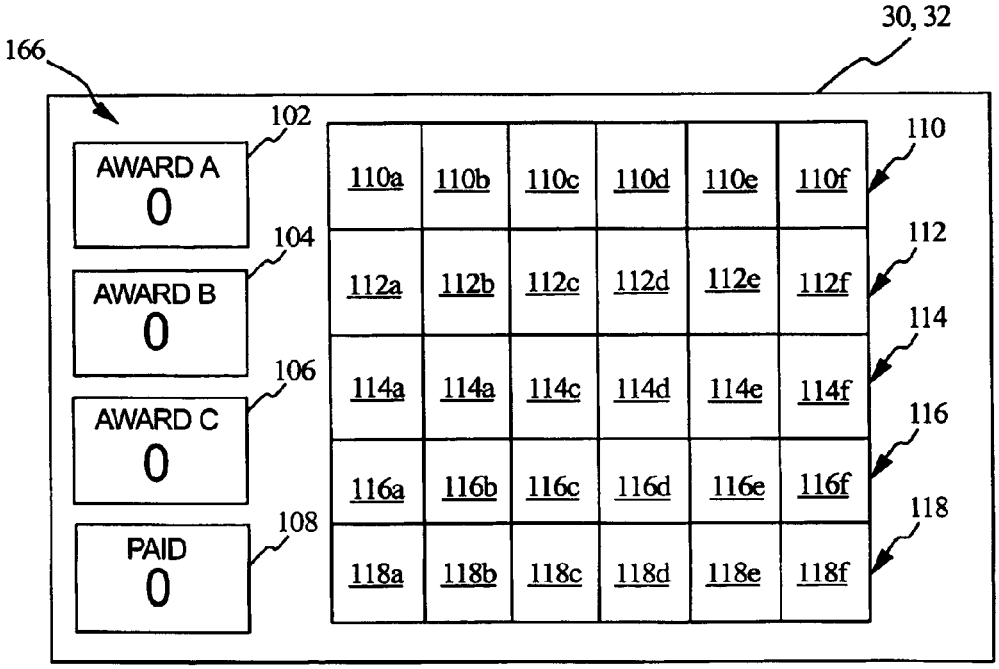
FIG. 17 is an elevation view of a display device illustrating another alternative initial screen of the present invention.

Referring now to FIGS. 16 and 17, separate screens 164 and 166 respectively display alternative initial screen embodiments. The screen 164 illustrates that gaming device 10 may present only a single set of choices to the player. In the illustrated embodiment, only the set 110 having choices 110*a* through 110*f* is presented. The set 110 in the screen 164 displays an additional choice 110*f* (FIGS. 3 to 12 have only choices a to e), which illustrates that the present invention may have different numbers of choices in different sets and in different embodiments.

The screen 166 of FIG. 17 illustrates that gaming device 10 may increment or build any number of awards, e.g., Awards A through C (previous embodiments included only two awards A and B). The screen 166 illustrates five sets, namely, the sets 110 through 118 (previous embodiments included only three sets). The screen 166 therefore illustrates that the gaming device 10 may be adapted to have any number of awards and any number of sets.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a display device;

a plurality of sets of selectable choices;

a first award adapted to be changed at least once by a selection of at least one of the choices from at least one of the sets of choices;

a second award adapted to be changed at least once by a selection of at least one of the choices from at least one of the sets of choices; and a processor operable:

(a) to cause the display device to display at least one of the sets of choices, the first award and the second awards;

(b) to enable a player to select a plurality of the choices from one of the displayed sets of choices;

(c) to display changes to at least one of the first or the second awards based on the selected choices;

(d) to cause the selection of one of the first or second awards when the selectable choices can no longer be selected from the sets of choices; and (e) to provide the player with said selected award.

2. The gaming device of claim 1, wherein the plurality of sets of choices are simultaneously displayed by the display device.

3. The gaming device of claim 1, wherein each set of choices includes at least one choice that changes the first award.

4. The gaming device of claim 1, wherein each set of choices includes at least one choice that changes the second award.

5. The gaming device of claim 1, wherein each set of choices includes at least one choice that changes the first award and at least one choice that changes the second award.

6. The gaming device of claim 1, which includes a terminator in each set of choices, wherein selection of the terminator from one of the sets of the choices stops further selection of choices from said set.

7. The gaming device of claim 6, wherein the terminators enable the player to select at least one choice from another set of choices.

8. The gaming device of claim 1, wherein the player selects the first or second award.

9. The gaming device of claim 1, wherein the sets of choices are sequentially displayed by the display device.

10. The gaming device of claim 1, wherein the sets of choices are sequentially indicated by the display device.

11. The gaming device of claim 1, wherein each set of choices includes different choices.

12. A gaming device comprising:

a plurality of sets of selectable choices;

an input device;

a plurality of values associated with said choices;

a first award adapted to be changed at least once by a selection of at least one of the choices from at least one of the sets of choices;

a second award adapted to be changed at least once by a selection of at least one of the choices from at least one of the sets of choices;

a display device; and at least one processor operable with the display device and the input device to display at least one of the sets of choices, to enable a player to select a plurality of the choices from at least one of the displayed sets of choices, to change at least one of the first or the second awards based on the selected choices, to enable a player to select one of the first and second awards when the selectable choices can no longer be selected from the sets of choices and to provide the player with said selected award.

13. The gaming device of claim 12, wherein the plurality of sets of choices are simultaneously displayed by the display device.

14. The gaming device of claim 12, wherein each set of choices includes at least one choice that changes the first award.

15. The gaming device of claim 12, wherein each set of choices includes at least one choice that changes the second award.

16. The gaming device of claim 12, wherein each set of choices includes at least one choice that changes the first award and at least one choice that changes the second award.

17. The gaming device of claim 12, wherein each set of choices includes at least one terminator, wherein selection of one of the terminators from one of the sets of choices ends further selection of choices from said set.

18. The gaming device of claim 17, wherein the terminators include a number of game credits or a multiplier for changing the first or second awards.

19. The gaming device of claim 18, wherein the terminators enable the player to select from a different set of choices.

20. The gaming device of claim 13, wherein the sets of choices are sequentially displayed by the display device.

21. The gaming device of claim 13, wherein the sets of choices are sequentially indicated by the display device.

22. The gaming device of claim 13, wherein each set of choices includes different choices.

23. A gaming device comprising:

a plurality of sets of selectable choices, wherein at least one set of choices includes a terminator;

a plurality of values associated with said choices;

a first award;

a second award;

an input device;

a display device; and at least one processor operable with the display device and the input device to:

(a) for each of a plurality of different sets of choices:

(i) display said set of choices;

(ii) enable a player to select at least one of the choices of said displayed set of choices;

(iii) change at least one of the first or the second awards based on any value associated with the selected choice;

(iv) repeat steps (ii) and (iii) until one of said terminators is selected or until each choice in said displayed set of choices has been selected;

(b) cause the selection of the first award or the second award; and (c) provide the player with said selected award.

24. The gaming device of claim 23, wherein a plurality of the sets of choices are simultaneously displayed by the display device.

25. The gaming device of claim 23, wherein each set of choices includes at least one choice that changes the first award.

26. The gaming device of claim 23, wherein each set of choices includes at least one choice that changes the second award.

27. The gaming device of claim 23, wherein each set of choices includes at least one choice that changes the first award and at least one choice that changes the second award.

28. The gaming device of claim 23, wherein at least one of the terminators is associated with a number of game credits or a multiplier for changing the first or second awards.

29. The gaming device of claim 23, wherein the sets of choices are sequentially displayed by the display device.

30. The gaming device of claim 23, wherein the sets of choices are sequentially indicated by the display device.

31. The gaming device of claim 23, wherein each set of choices includes different choices.

32. The method of operating a gaming device, said method comprising:

(a) displaying a plurality of sets of selectable choices;

(b) enabling a player to select a plurality of the choices from one of the displayed sets of choices;

(c) changing at least one of a first award or a second award at least once based on at least one of said selected choices;

(d) causing the selection of the first award or the second award when the selectable choices can no longer be selected from the sets of choices; and (e) providing said selected award to the player.

33. The method of claim 32, which includes simultaneously displaying each set of choices.

34. The method of claim 32, which includes changing the first award based on at least one of said selected choices.

35. The method of claim 32, which includes changing the second award based on at least one of said selected choices.

36. The method of claim 32, which includes changing the first award and the second award on based on at least one of said selected choices.

37. The method of claim 32, which includes terminating further selection of choices from one of the sets of choices if a terminator is chosen from said set.

38. The method of claim 37, which includes enabling the player to select at least one choice from another set of choices if one of the terminators is selected.

39. The method of claim 37, which includes changing a number of game credits or changing one of the first or the second awards if one of the terminators is selected.

40. The method of claim 37, which includes indicating a first set of choices from the plurality of sets of choices, enabling the player to select at least one choice from said indicated set, and if the player selects one of the terminators in said indicated set, indicating a second set of choices and enabling the player to select at least one choice from said second indicated set.

41. The method of claim 32, wherein each set of choices is sequentially displayed by the display device.

42. The method of claim 32, wherein each set of choices is sequentially indicated by the display device.

43. The method of claim 32, wherein each set of choices includes different choices.

44. The method of operating a gaming device, said method comprising:

(a) displaying at least one set of selectable choices;

(b) associating a plurality of values with a plurality of said choices;

(c) enabling a player to select a plurality of said choices from at least one of the sets of choices;

(d) changing at least one of a first award or a second award at least once based on at least one value associated with at least one of said selected choices;

(e) enabling the player to select the first award or the second award when the choices can no longer be selected from the sets of choices; and (f) providing the player with said selected award.

45. The method of claim 44, which includes simultaneously displaying each set of choices.

46. The method of claim 44, which includes changing the first award based on at least one of said selected choices.

47. The method of claim 44, which includes changing the second award based on at least one of said selected choices.

48. The method of claim 44, which includes changing the first award and the second award based on at least one of said selected choices.

49. The method of claim 44, which includes terminating further selection of choices from one of the sets of choices if a terminator is chosen from said set.

50. The method of claim 49, which includes enabling the player to select at least one choice from another set of choices if one of the terminators is selected.

51. The method of claim 44, wherein each set of choices is sequentially displayed by the display device.

52. The method of claim 44, wherein each set of choices is sequentially indicated by the display device.

53. The method of claim 44, wherein each set of choices includes different choices.

54. A method of operating a gaming device, said method comprising:

(a) displaying a plurality of sets of selectable choices, wherein at least one of said plurality of sets of choices includes a terminator;

(b) indicating at least one of the plurality of displayed sets of selectable choices;

(c) associating a plurality of values with a plurality of the displayed choices;

(d) enabling a player to select at least one of the choices from said indicated set of choices;

(e) changing at least one of a first award or a second award based on a value associated with the selected choice;

(f) repeating steps (c) to (e) until one of the terminators is selected or each choice in said indicated set of choices has been selected;

(g) repeating steps (a) to (f) for a plurality of different sets of choices;

(h) enabling the player to select one of the first or second awards; and (i) providing the player with said selected award.

55. The method of claim 54, which includes simultaneously displaying a plurality of the plurality of sets of choices.

56. The method of claim 54, which includes changing the first award based on at least one of said selected choices.

57. The method of claim 54, which includes changing the second award based on at least one of said selected choices.

58. The method of claim 54, which includes changing the first award and the second award based on at least one of said selected choices.

59. The method of claim 54, wherein each set of choices is sequentially displayed by the display device.

60. The method of claim 54, wherein each set of choices is sequentially indicated by the display device.

61. The method of claim 54, wherein each set of choices includes different choices.

* * * * *